US010080390B2

(12) United States Patent
LaHann

(10) Patent No.: US 10,080,390 B2
(45) **Date of Patent: *Sep. 25, 2018**

(54) CLOTHING CLIP APPARATUS AND METHOD FOR USING SAME

(71) Applicant: HAPPY FIG, LLC, Chicago, IL (US)

(72) Inventor: Melissa LaHann, Chicago, IL (US)

(73) Assignee: Happy Fig, LLC, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/407,143

(22) Filed: Jan. 16, 2017

(65) Prior Publication Data

US 2017/0119067 A1 May 4, 2017

Related U.S. Application Data

(63) Continuation of application No. 14/546,411, filed on Nov. 18, 2014, now Pat. No. 9,565,879.

(60) Provisional application No. 61/911,778, filed on Dec. 4, 2013.

(51) Int. Cl.

| | |
|---|---|
| ***A41D 1/20*** | (2006.01) |
| ***A41D 1/215*** | (2018.01) |
| ***A41F 1/00*** | (2006.01) |
| ***A41F 19/00*** | (2006.01) |

(52) U.S. Cl.

CPC ..... *A41D 1/215* (2018.01); *A41D 1/205* (2013.01); *A41F 1/002* (2013.01); *A41F 19/00* (2013.01)

(58) Field of Classification Search

CPC ..... A41B 13/10; A41D 27/10; A41D 20/00; A41D 1/205; A41F 11/16; A41F 9/002

See application file for complete search history.

(56) References Cited

U.S. PATENT DOCUMENTS

| | | | | |
|---|---|---|---|---|
| 6,081,925 | A * | 7/2000 | Reiber | A41F 19/005 2/125 |
| 6,272,691 | B1 * | 8/2001 | Henricksen | A41F 19/005 2/126 |
| 6,427,244 | B1 * | 8/2002 | Speier | A41D 1/205 2/104 |
| 6,681,405 | B2 * | 1/2004 | Yachimec | A41D 1/205 2/104 |
| 6,775,846 | B1 * | 8/2004 | LaFauci | A41F 19/005 2/125 |

(Continued)

*Primary Examiner* — Tejash Patel

(74) *Attorney, Agent, or Firm* — Lempia Summerfield Katz LLC

(57) ABSTRACT

A nursing apparatus is configured to hold a garment in a gathered position to expose a breast for nursing. The apparatus has a strap with a first end and a second end. A fastener is disposed at the first end and is configured to connect the first end to a piece of clothing of the wearer. The fastener has a body portion attached to the strap and a movable part. A ring is disposed at the second end of the strap and configured to retain the strap in a closed loop shape to hold the garment in the gathered position. A method includes manufacturing the strap with the fastener at the first end and the ring positioned at the second end of the strap. The method includes instructing the wearer to lift the garment to form a gathered portion of the garment, form a loop shape with the strap around the gathered portion, and utilize the ring to retain the strap in the loop shape to hold the gathered portion in a fixed position relative to the wearer to expose a breast for nursing.

20 Claims, 8 Drawing Sheets

(56) References Cited

U.S. PATENT DOCUMENTS

| | | | | |
|---|---|---|---|---|
| 7,222,372 | B1 * | 5/2007 | Bruckart | A41C 3/08 2/106 |
| 9,565,879 | B2 * | 2/2017 | LaHann | A41D 1/205 |
| 2017/0000249 | A1 * | 1/2017 | Beck | A41F 9/002 |

* cited by examiner

CLOTHING CLIP APPARATUS AND METHOD FOR USING SAME

CROSS-REFERENCE TO RELATED APPLICATIONS

This application is a continuation of and claims the priority benefit of pending U.S. patent application Ser. No. 14/546,411 filed on Nov. 18, 2014, which claims the benefit of U.S. Provisional Patent Application No. 61/911,778, filed Dec. 4, 2013. The entirety of each of these prior filed applications is hereby incorporated herein by reference.

BACKGROUND

The present disclosure relates to a clothing clip apparatus and a method for using same. More specifically, the present disclosure relates to a clothing clip apparatus and a method for using same which may secure a garment in a position to allow a woman to nurse a child.

In general, while breast feeding a child, a woman may need to move her clothing to permit access for her child to her breast(s). She may have to hold her shirt or blouse away from her breast(s). A woman typically uses one of her hands to hold the shirt away from her breast. However, doing so may prevent the woman from securely holding and/or positioning the child for feeding. In some cases, a woman may contort her neck to use her head to retain her shirt in the necessary position which may make breast feeding uncomfortable. A woman may also attempt to hold her garment away from her child by using her teeth and/or mouth to hold the garment. Also, a woman may need assistance from another person in preparing for and/or performing the breast feeding and/or when a woman uses a breast pump.

Another common problem may occur when the top garment of the nursing woman may tend to fall back down, at least partially covering the breast that the child is attempting to access for feeding. The garment may thus interfere with access to the breast for the nursing child. This obstruction and/or interference may be annoying to the baby and/or the woman. The interference may render the child unable to properly feed in such an instance. The child may become frustrated to the point of not feeding properly and/or not feeding at all.

To combat the tendency of the top to slide down and/or obstruct the breast, the woman may have to manually hold her top and/or repeatedly re-position her top when the top may slide down. Moreover, the nursing woman may have to remove her top entirely. Such solutions are inconvenient, time-consuming and/or annoying for the woman and/or child.

A need, therefore, exists for a device and/or a method which may be used to quickly and/or conveniently hold a garment above the breast(s) of a woman during the nursing process of a child. Also, a need exists for a device and/or method which may be used to hold a garment above the breast(s) when a woman uses a breast pump. Further, a need exists for a device and/or a method which frees both hands of a woman during breast feeding so that she may more securely hold the child in the proper position for greater comfort and/or security for the woman and/or the nursing child.

SUMMARY

The present disclosure relates to a clothing clip apparatus and a method for using same. More specifically, the present disclosure relates to a clothing clip apparatus and a method for using same, whereby the clothing clip apparatus may secure or hold a garment in a position to allow a woman to nurse a child.

In one example, according to the teachings of the present disclosure, a method includes producing a strap having a first end, a second end opposite the first end, and a length between the first end and the second end. The method includes providing a fastener at the first end of the strap. The fastener has a first part attached to the strap and a movable part that is movable relative to the first part. The method includes positioning a ring at the second end of the strap. The method further includes instructing the wearer to lift part of the garment to form a gathered portion of the garment, form a loop shape with the strap around the gathered portion, and utilize the ring to retain the strap in the loop shape to thereby hold the gathered portion of the garment in a fixed position relative to the wearer of the garment to expose a breast for nursing.

In one example, in the step of providing, the movable part can be pivotable relative to the first part.

In one example, the method can further include the step of further instructing the wearer of the garment to attach a cover to the strap whereby the cover is positioned over the garment and the exposed breast.

In one example, the step of instructing can further include instructing the wearer to use only one hand to lift part of the garment, to form the loop shape in the strap around the gathered portion, and to utilize the ring to retain the strap in the loop shape.

In one example, according to the teachings of the present disclosure, an apparatus is configured for holding a garment in a gathered position to expose a breast of a wearer of the garment. The apparatus includes a strap having a first end, a second end opposite the first end, and a length between the first end and the second end. The apparatus includes a fastener at the first end of the strap. The fastener is configured to connect the first end to a piece of clothing of the wearer. The fastener has a body portion attached to the strap and a movable part that is movable relative to the body portion. A ring is disposed at the second end of the strap. The ring is configured to retain the strap in a closed loop shape to hold the garment in the gathered position within the closed loop shape.

In one example, the apparatus can include a magnet at the first end of the strap. The magnet can attract the ring to retain the strap in the closed loop shape.

In one example, the length of the strap can be adjustable.

In one example, the apparatus can include a series of magnets positioned lengthwise along the strap to render the length of the strap adjustable. Each magnet of the series of magnets can be attracted to the fastener.

In one example, the apparatus can include an adjustment slide positioned between the first end and the second end of the strap to set a desired length for the strap.

In one example, the apparatus can include a first magnet at the first end of the strap and a second magnet at the second end of the strap. The first magnet and the second magnet can be attracted to one another.

In one example, the apparatus can include a fabric pocket formed in the strap. The fabric pocket can be configured to enclose an object such as a magnet or a part of the fastener.

In one example, the apparatus can include a cover that can attach to and hang from the strap to cover the exposed breast.

In one example, the fastener can be configured to attach to a neck opening or a collar on the garment.

In one example, according to the teachings of the present disclosure, an apparatus is configured for holding a garment to expose a breast for nursing. The apparatus includes a strap having a first end and a second end spaced lengthwise from the first end. A clip has a fixed base attached to the first end of the strap. The clip has a movable part that protrudes and is movable relative to the fixed base to attach the strap to a piece of clothing of a wearer of the garment. A magnetic portion is disposed at the first end of the strap. A magnet is attached to the second end of the strap. The magnetic portion attracts the magnet to connect the second end to the first end to configure the strap in a closed loop shape to retain the garment in a gathered position within the closed loop shape.

In one example, the magnetic portion can be either an auxiliary magnet or a metallic portion of the clip.

In one example, the apparatus can include one or more additional magnets located at various positions along a length of the strap to permit the closed loop shape to be configured having a selected size.

In one example, the apparatus can include an attachment device that can be configured to engage the clip to assist in forming the closed loop shape.

In one example, the apparatus can include an attachment device to help in forming the closed loop shape of the strap. The attachment device can be a ring attached to the second end of the strap. The ring can be configured to removably engage the clip.

In one example according to the teachings of the present disclosure, a method includes holding, with one hand, a strap having a first end and a second end opposite the first end. The method includes manipulating a fastener at the first end of the strap, with the one hand, to attach the strap to a piece of clothing. The fastener has a first part attached to the strap and a movable part that is movable relative to the first part. The method includes lifting part of a garment, with the one hand, to form a gathered portion of the garment. The method includes forming, with the one hand, a loop shape with the strap around the gathered portion of the garment. The method also includes utilizing, with the one hand, a ring at the second end of the strap to retain the strap in the loop shape to thereby hold the gathered portion of the garment in a fixed position relative to a wearer of the garment to expose a breast of the wearer for nursing.

In one example, the step of manipulating can include manipulating the fastener, with the one hand, to attach the strap to the garment.

It is, therefore, an advantage of the present disclosure to provide a clothing clip apparatus and a method for using same to secure a garment in a position to allow a woman to nurse a child.

Another advantage of the present disclosure is to provide a clothing clip apparatus and a method for using same which may reduce an amount of time required for securing a garment in a position to allow a woman to nurse a child.

Yet another advantage of the present disclosure is to provide a clothing clip apparatus and a method for using same which may reduce an amount of effort required for securing a garment in a position to allow a woman to nurse a child.

Another advantage of the present disclosure is to provide a clothing clip apparatus and a method for using same which may allow a user to secure a garment in a position using only one hand.

An advantage of the present disclosure is to provide a clothing clip apparatus and a method for using same which is constructed of materials and/or components that do not harm the garment of a user.

A still further advantage of the present disclosure is to provide a clothing clip apparatus and a method for using same which is easy to operate by a single user while holding a child.

A further advantage of the present disclosure is to provide a clothing clip apparatus and a method for using same which is capable of securing garments of varying bulk, thickness and/or weight.

Moreover, an advantage of the present disclosure is to provide a clothing clip apparatus and a method for using same which is capable of securing more than one garment simultaneously.

A further advantage of the present disclosure is to provide a clothing clip apparatus and a method for using same which may be used without causing harm to the child while in use.

Another advantage of the present disclosure is to provide a clothing clip apparatus and a method for using same which may be used without the child being able to unlatch the apparatus.

Moreover, an advantage of the present disclosure is to provide a clothing clip apparatus and a method for using same which may be used without the child becoming entangled in the apparatus.

Another advantage of the present disclosure is to provide a clothing clip apparatus and a method for using same which is lightweight.

Yet another advantage of the present disclosure is to provide a clothing clip apparatus and a method for using same which may have an apparatus made of a resilient material.

A further advantage of the present disclosure is to provide a clothing clip apparatus which is easy to clean.

Another advantage of the present disclosure is to provide a clothing clip apparatus which is resistant to water, mold and mildew.

Still further, an advantage of the present disclosure is to provide a clothing clip apparatus and a method for using same which is adjustable in length.

Yet another advantage of the present disclosure is to provide a clothing clip apparatus and a method for using same which is inexpensive.

Another advantage of the present disclosure is to provide a clothing clip apparatus and a method for using same which can be attached to a nursing cover to provide privacy, shade, warmth and/or the like while the child is nursing.

A further advantage of the present disclosure is to provide a clothing clip apparatus and a method for using same which may attach to a nursing cover to form a single unit.

Yet another advantage of the present disclosure is to provide a clothing clip apparatus and a method for using same which may be adapted to hold a swatch and/or substantial piece of fabric and/or similar material to provide privacy, shade, warmth, or similar while the child is nursing.

Still another advantage of the present disclosure is to provide a clothing clip apparatus and a method for using same which may be configured to hold a pacifier, a teething device, toys, a key ring, keys, building access cards, travel items, hand sanitizer, lip moisturizer, burp cloths, bibs, nursing covers and/or the like that the user may need at his or her disposal.

A further advantage of the present disclosure is to provide a clothing clip apparatus and a method for using same which attaches to a piece of clothing of the user.

Another advantage of the present disclosure is to provide a clothing clip apparatus and a method for using same which can be used to secure apparel for a child to prevent soiling the apparel during potty training.

Additional features and advantages of the present disclosure are described in, and will be apparent from, the detailed description of the presently preferred embodiments and from the drawings.

DETAILED DESCRIPTION OF THE PRESENTLY PREFERRED EMBODIMENTS

The present disclosure relates to a clothing clip apparatus 10 and a method for using same. More specifically, the present disclosure relates to the clothing clip apparatus 10 and a method for using same which may secure a garment 11, for example, a shirt, blouse, sweatshirt, sweater and/or the like, in a position to allow a woman to nurse a child.

Figure 3:
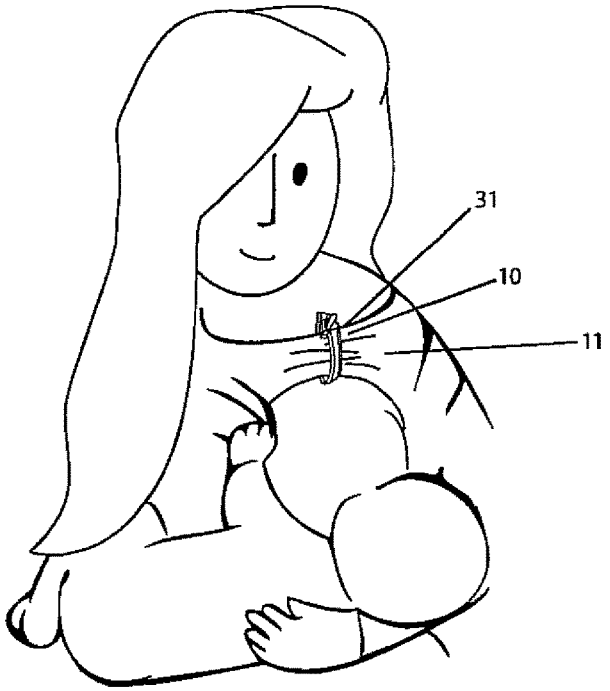
FIG. 3 illustrates a clothing clip in accordance with an embodiment of the present disclosure as used in accordance with the method disclosed herein.

Referring now to the drawings, wherein like numerals refer to like parts, FIG. 3 illustrates a woman 5 breast feeding a child 6 using an embodiment of the clothing clip apparatus 10. The clothing clip apparatus 10 may be used to secure the garment 11 in a position which exposes the breast to permit the child 6 to access the breast thereby allowing the woman 5 to nurse the child 6.

FIGS. 1, 2, 4-11 illustrate various embodiments of the clothing clip apparatus 10. The clothing clip apparatus 10 may be used to secure the garment 11 in a position to allow the woman 5 to nurse the child 6. The clothing clip apparatus 10 may also be used to hold other articles as desired.

Figure 1:
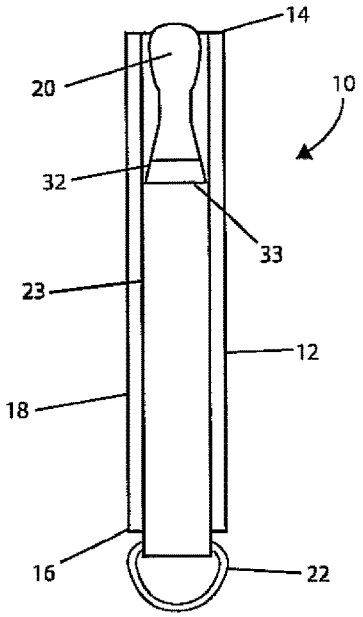
FIG. 1 illustrates a front view of a clothing clip in accordance with an embodiment of the present disclosure.

In an embodiment shown in FIG. 1, the clothing clip apparatus 10 may have a generally rectangular strap 12 having a length and a width. Of course, the strap 12 may be configured in a variety of shapes to accommodate variations in use. The variations may be due to garment size, garment weight, user size and the like. Thus, the generally rectangular shape of the strap 12 may be fixed, adjustable, narrowed, broadened, lengthened and/or shortened depending on the woman and the garment being secured. The shape of the strap 12 may also be designed for the size of the woman and/or the garment 11 that may be worn by the woman.

The strap 12 may be constructed from a number of materials, for example, a heavyweight flat polypropylene webbing, flat nylon webbing, a tubular polypropylene webbing, a tubular polyester webbing, a cotton fabric, an elastic material, rubber, plastic, leather, silicone, string, rope, cord, nylon and/or like material. The strap 12 may be constructed from a resilient material, an antimicrobial material and/or a waterproof or water-resistant material. Certain materials may provide better durability, care and/or maintenance. Also, a particular material for the strap 12 may be selected to improve the performance and/or comfort of the clothing clip apparatus 10 for the woman and the child.

As shown in the figures, the strap 12 may have a top end 14 and a bottom end 16. The bottom end 16 may be located opposite the top end 14. The strap 12 may also have a front side 18 and a back side 19. The back side 19 may be located in a position opposite to the front side 18. A clip 20 may be located in a position adjacent to the top end 14 of the strap 12. The clip 20 may be attached to the front side 18 of the strap 12. The clip 20 may be sewn, glued, grommeted or otherwise attached to the strap 12. The clip 20 may constructed from metal, plastic, wood and/or other material. The clip 20 may be constructed from a magnetic material, such as, steel, iron and/or the like.

In an embodiment, the clip 20 may be hinged and/or may have a spring (not shown). For example, the clip 20 may have a fixed base 15 that may be attached to the strap 12. The clip 20 may have a movable part 17 that may be connected to the fixed base 15. The movable part 17 may pivot and/or may rotate with respect to the fixed base 15.

The strap 12 may have a ring 22 located at the bottom end 16. The ring 22 may be sewn, glued or otherwise attached to the strap 12. The ring 22 may pivot relative to the strap 12. The ring 22 may also be circular, semi-circular, rectangular, triangular or any other shape. The ring 22 may be constructed of metal, plastic or other material.

The strap 12 may also have a fabric 23 attached to the strap 12. The fabric 23 may be a polyester or polypropylene ribbon, for example. The fabric 11 may be sewn, glued or otherwise attached to the strap 12. The fabric 23 may be attached to the front 18 and/or the back 19 of the strap 12. In an embodiment, the fabric 23 may be sewn onto the strap 12 to secure the clip 20 to the strap 12. The fabric 23 may also provide distinguishing, identifying and/or decorative features to the clothing clip apparatus 10. Moreover, the fabric 23 may have a tight weave with low water absorption and mildew resistance. The fabric 23 may be looped around the base of the ring 22 to secure the ring 22 to the strap 12. In particular, as shown in FIGS. 1, 2, 4, 5, 10 and 11, the ring 22 may be a D-ring 24, and the fabric 23 may be looped around a flat base 25 of the D-ring 24 to secure the ring 22 to the strap 12. The fabric 23 may be sewn to the strap 12 to encircle the flat base 25 of the D-ring 24. Thus, the fabric 23 may securely hold the D-ring 24 at the bottom end 16 of the strap 12. The D-ring 24 may pivot relative to the strap 12.

In embodiments of the clothing clip apparatus 10, a magnet 30 may be attached to the clothing clip apparatus 10. The magnet 30 may be located in different locations to aid in securing the garment 11 in a desired position using the clothing clip apparatus 10 for nursing the child. For example, in FIG. 2, the magnet 30 may be sewn into the strap 12 and/or the fabric 23 adjacent the top end 14 of the strap 12. In an embodiment, the fabric 23 may be sewn onto the strap 12 to secure the magnet 30.

In embodiments of the clothing clip apparatus 10, the clothing clip apparatus 10 may be attached to the garment 11 to aid in securing the garment 11 in a desired position for nursing the child. To this end, the clip 20 may be attached to a collar 31 of the garment 11 as shown in FIG. 1. In addition, the clip 20 may have a soft tip 32 on a bottom end 33 of the clip 20. The soft tip 32 may be a rubber guard or other suitable material. The soft tip 32 may contact the garment 11. The soft tip 32 may guard and/or prevent the clip 20 from creating any pulls in the garment 11. Thus, the clothing clip apparatus 10 may be used on garments 11 made of delicate fabrics, such as silk, for example, without damaging the garment 11.

Figure 2:
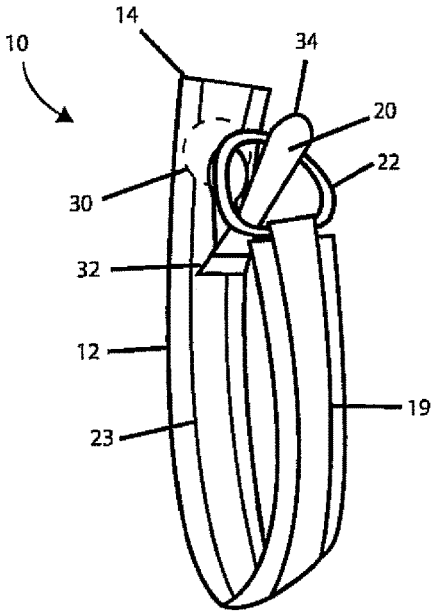
FIG. 2 illustrates a perspective view of a clothing clip in accordance with an embodiment of the present disclosure.

Referring to FIGS. 1-3, the clip 20 may hold the top end 14 of the strap 12 at the collar 31 and the bottom end 16 of the strap 12 and the ring 22 of the clothing clip apparatus 10 may be dropped inside the garment 11. The woman may grab the ring 22 and lift the garment 11. The garment 11 may be lifted into a desired position for nursing the child. For example, the breast may be exposed to allow the woman and/or the child access for nursing. The ring 22 may then be positioned over a top end 34 of the clip 20 to form a loop with the strap 12 around the garment 11. The ring 22 may hook onto the clip 20. The ring 22 may also be magnetically attracted to the magnet 30. The magnetic attraction between the ring 22 and the magnet 30 may provide additional security for retaining the garment 11 in the desired position during nursing. In general, the magnet 30 may have a certain magnetic attractiveness value. The magnet 30 may have a magnetic strength to maintain the ring 22 over the clip 20 until removed by the woman. The method of securing the garment 11 using the clothing clip apparatus 10 may be performed by the woman without assistance. Further, the method of securing the garment 11 using the clothing clip apparatus 10 may be performed by the woman using only one hand. Thus, the woman may hold and/or may position the child during the process of securing the garment 11 for the nursing process.

Removing the clothing clip apparatus 10 may also be performed by the woman by herself and/or with only one hand. The ring 22 may be pulled from the magnet 30 to overcome the attractive force. The ring 22 may then be lifted over the top end 34 of the clip 20. The strap 12 may fall under the garment 11. The garment 11 may also fall. The woman may unclip the clip 20 from the collar 31 of the garment 11 and remove the clothing clip apparatus 10. The garment 11 may then be repositioned on the woman as desired.

Figure 4:
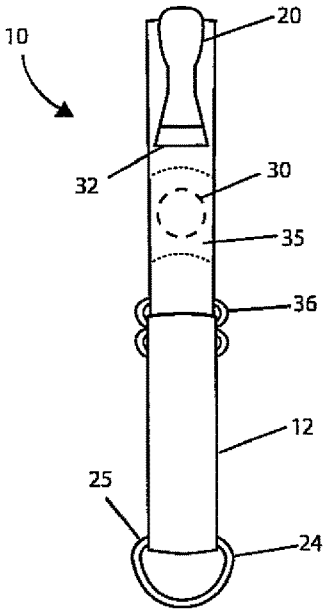
FIG. 4 illustrates a front view of a clothing clip in accordance with an embodiment of the present disclosure.
Figure 10:
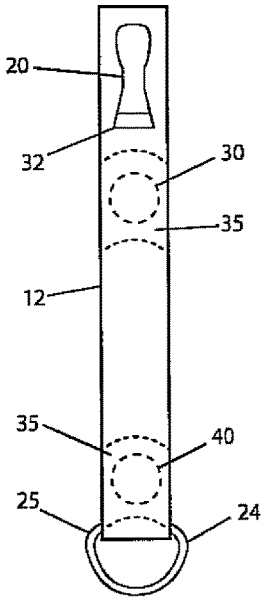
FIG. 10 illustrates a front view of a clothing clip in accordance with an embodiment of the present disclosure.
Figure 11:
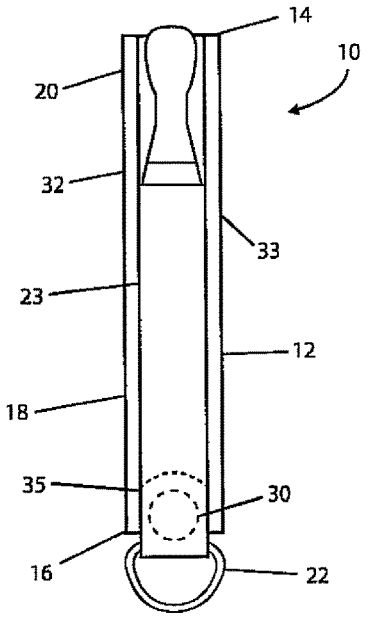
FIG. 11 illustrates a front view of a clothing clip in accordance with an embodiment of the present disclosure.

In an embodiment, the strap 12 may be rigid to ensure the clip 20 remains upright during use and/or to prevent the clip 20 from being pulled forward by the ring 22. The ring 22 may be separated from the clip 20. Rigidity in the strap 12 may also be easier to locate under the garment 11. In various embodiments, different materials may provide specific advantages. For example, tubular polypropylene may advantageously permit enclosing the magnet 30. Flat polypropylene webbing may provide a more structured material for the strap 12. Flat polypropylene webbing may provide UV protection so that the color of the strap 12 of the clothing slip apparatus 10 may not fade. Flat polypropylene webbing may also not absorb water. Thus, flat polypropylene webbing may thereby provide resistance to mildew and/or to rot. Such advantages may be desirable for the clothing clip apparatus 10 that may be used in conjunction with nursing a child. In addition, the nature of the flat polypropylene webbing material may enable a tight stitch to be sewn for creating a fabric pocket 35 as shown in FIGS. 4, 10 and 11 to enclose the magnet 30. The fabric 23 may also be used to make the pocket 35 to enclose the magnet 30. Also, the flat polypropylene webbing may provide a good feel, comfort and/or a finished look to the clothing clip apparatus 10.

In an embodiment, the clothing clip apparatus 10 may be adjustable in length as shown in FIG. 4. The strap 12 may have an adjustment slide 36 that may be may be positioned between the top end 14 and the bottom end 16 of the strap 12 to set a desired length for the strap 12. The adjustment slide 36 may operate as known in the art. The woman may adjust the length of the strap 12 to secure the garment 11. For example, the length of the strap 12 may be lengthened to accommodate a larger garment 11, such as a sweatshirt or sweater, for example. The length of the strap 12 may be shortened to secure a thinner, lighter weight garment, such as a silk blouse or tank top, for example. Thus, the clothing clip apparatus 10 may be adjusted seasonally as the wardrobe of the woman may change. However, the clothing clip apparatus 10 may perform with any type of garment 11 and may not necessarily be adjustable for proper operation.

Figure 5:
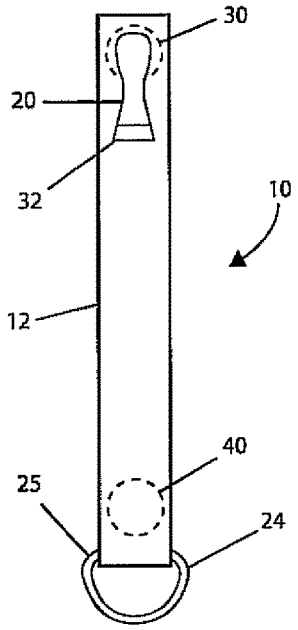
FIG. 5 illustrates a front view of a clothing clip in accordance with an embodiment of the present disclosure.

Referring now to FIG. 5, the clothing clip apparatus 10 may have an auxiliary magnet 40. The auxiliary magnet 40 may be sewn into the strap 12 and/or the fabric 23 adjacent the bottom end 16 of the strap 12. When the clothing clip apparatus 10 may be used to secure the garment 11, the auxiliary magnet 40 may magnetically engage the clip 20. The magnetic attraction between the ring 24 and the magnet 30 may be coupled with the magnetic attraction between the auxiliary magnet 40 and the clip 20 to provide further security for retaining the garment 11 in the desired position during nursing.

Figure 6:
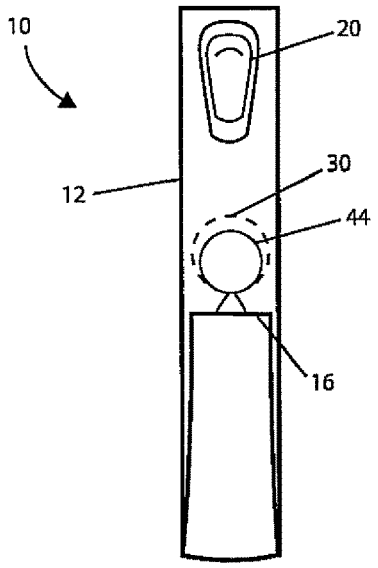
FIG. 6 illustrates a front view of a clothing clip in accordance with an embodiment of the present disclosure.

Referring now to FIG. 6, the clothing clip apparatus 10 may have the magnet 30 located at a position below the clip 20. The magnet 30 may be sewn into the strap 12 and/or the fabric 23. The clothing clip apparatus 10 may have a metal disc 44 that may be connected to the bottom end 16 of the strap 12. The metal disc may be magnetic. The metal disc 44 may be sewn into the strap 12 and/or the fabric 23 adjacent the bottom end 16 of the strap 12. When the clothing clip apparatus 10 may be used to secure the garment 11, the metal disc 44 may magnetically engage the magnet 30. The magnetic attraction between the metal disc 44 and the magnet 30 may securely retain the garment 11 in the desired position during nursing. The metal disc 44 may also be magnetic. In such a case, the magnetic metal disc 44 may engage the magnet 30 and/or the clip 20 to secure the garment 11 during nursing.

Figure 7:
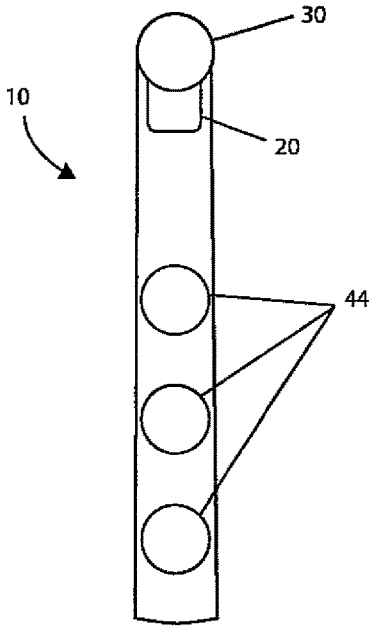
FIG. 7 illustrates a front view of a clothing clip in accordance with an embodiment of the present disclosure.

Referring now to FIG. 7, the clothing clip apparatus 10 may have the magnet 30 located on the clip 20. The magnet 30 may attached to the clip 20 by an adhesive or other suitable means. The clothing clip apparatus 10 may have metal discs 44 that may be connected to the front side 18 of the strap 16. The metal discs 44 may be magnetic. The metal discs 44 may be sewn into the strap 12 and/or the fabric 23. When the clothing clip apparatus 10 may be used to secure the garment 11, one of the metal discs 44 may magnetically engage the magnet 30. The magnetic attraction between the metal disc 44 and the magnet 30 may securely retain the garment 11 in the desired position during nursing. The metal disc 44 may also be magnetic. In such a case, the magnetic metal disc 44 may engage the magnet 30 and/or the clip 20 to secure the garment 11 during nursing. The strap 12 may encircle the garment 11 during use as shown in FIG. 3. In the embodiment of FIG. 7, in particular, the loop formed around the garment 11 by the strap 12 may be made tighter by using the metal disc 44 closer to the top end 14 of the strap 12.

Figure 8:
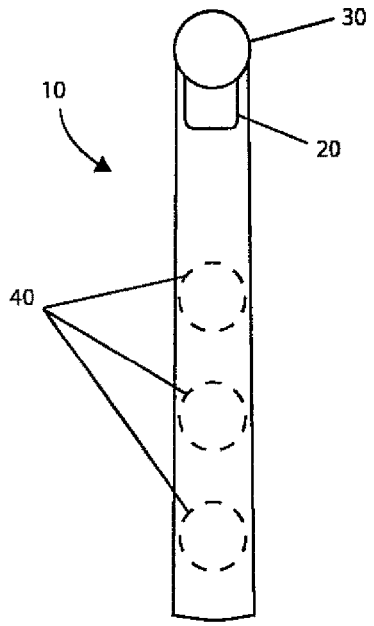
FIG. 8 illustrates a front view of a clothing clip in accordance with an embodiment of the present disclosure.

Referring now to FIG. 8, the clothing clip apparatus 10 may have the magnet 30 located on the clip 20. The magnet 30 may be attached to the clip 20 by an adhesive or other suitable means. The clothing clip apparatus 10 may have auxiliary magnets 40 connected to the front side 18 of the strap 16. The auxiliary magnets 40 may be sewn into the strap 12 and/or the fabric 23. When the clothing clip apparatus 10 may be used to secure the garment 11, one of the auxiliary magnets 40 may magnetically engage the magnet 30. The magnetic attraction between the auxiliary magnets 40 and the magnet 30 may securely retain the garment 11 in the desired position during nursing. The auxiliary magnets 40 may engage the magnet 30 and/or the clip 20 to secure the garment 11 during nursing. In the embodiment shown in FIG. 8, the strap 12 may encircle the garment 11 during use. In particular, the loop formed around the garment 11 by the strap 12 may be made tighter by using the auxiliary magnets 40 closer to the top end 14 of the strap 12.

Figure 9:
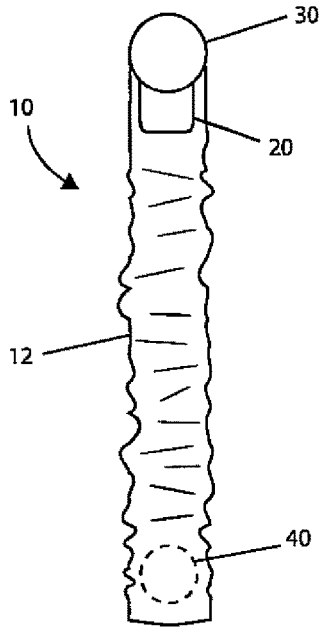
FIG. 9 illustrates a front view of a clothing clip in accordance with an embodiment of the present disclosure.

Referring now to FIG. 9, the clothing clip apparatus 10 may have the magnet 30 located on the clip 20. The magnet 30 may be attached to the clip 20 by an adhesive or other suitable means. The clothing clip apparatus 10 may have the auxiliary magnet 40 connected to the front side 18 of the strap 16 adjacent the bottom end 16 of the strap 12. The auxiliary magnet 40 may be sewn into the strap 12 and/or the fabric 23. In the embodiment shown in FIG. 9, the material of the strap 12 may be elastic.

When the clothing clip apparatus 10 may be used to secure the garment 11, one of the auxiliary magnets 40 may magnetically engage the magnet 30. The magnetic attraction between the auxiliary magnet 40 and the magnet 30 may securely retain the garment 11 in the desired position during nursing. The auxiliary magnets 40 may engage the magnet 30 and/or the clip 20 to secure the garment 11 during nursing. In the embodiment shown in FIG. 9, the strap 12 may encircle the garment 11 during use. In particular, the loop formed around the garment 11 by the strap 12 may be made tighter by the elastic feature of the strap 12.

Referring now to FIG. 10, the clothing clip apparatus 10 may have the magnet 30 located below the clip 20. The magnet 30 may be in the fabric pocket 35. The clothing clip apparatus 10 may also have the auxiliary magnet 40 located above the ring 22. The auxiliary magnet 40 may be sewn into the strap 12 and/or the fabric 23 adjacent the bottom end 16 of the strap 12. The auxiliary magnet 40 may be in the fabric pocket 35. When the clothing clip apparatus 10 may be used to secure the garment 11, the auxiliary magnet 40 may magnetically engage the magnet 30. The magnetic attraction between the magnet 30 and the auxiliary magnet 40 may provide further security for retaining the garment 11 in the desired position during nursing.

Referring now to FIG. 11, the magnet 30 may be sewn into the strap 12 and/or the fabric 23 adjacent to the bottom end 16 of the strap 12. The magnet 30 may be in the fabric pocket 35. When the clothing clip apparatus 10 may be used to secure the garment 11, the magnet 30 may magnetically engage the clip 20. The close proximity of the magnet 30 to the ring 22 may magnetize the ring 22. Thus, the ring 22 may be magnetically held to the clip 20 in addition to being looped over the clip 20 for securing the garment 11. Thus, the magnetic attraction between the magnet 30 and the clip 20 may provide further security for retaining the garment 11 in the desired position during nursing.

Accordingly, the clothing clip apparatus 10 may be worn by a user to secure the garment 11 worn by the user. Preferably, the woman may wear the clothing clip apparatus 10 while nursing. However, the disclosure should not be limited to securing the garment 11 during nursing, the clothing clip apparatus 10 may also be used to encircle and/or hold a sleeve of the user as desired, for example. Of course, other uses may be possible using the disclosure and are considered to be within the scope of the disclosure.

Figure 12:
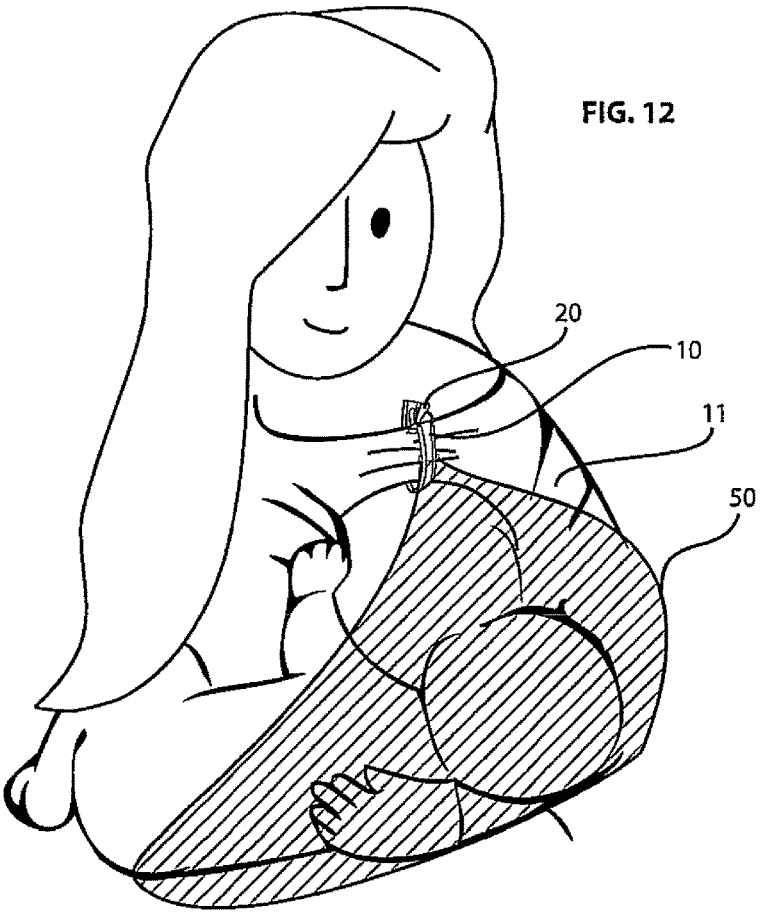
FIG. 12 illustrates a clothing clip in accordance with an embodiment of the present disclosure as used in accordance with the method disclosed herein.

Further, the clothing clip apparatus 10 may be worn by a user to hold a cover 50 that may be worn by the woman as shown in FIG. 12. Preferably, the woman may wear the clothing clip apparatus 10 while nursing. The cover 50 may provide privacy, shade, warmth and/or the like while the child is nursing. For example, the cover 50 may be constructed from a fabric and/or material that may fit over the front of the woman while nursing. The cover 50 may extend from the clothing clip apparatus 10 that may be located near the neck area over the torso of the woman. The cover 50 may be arranged to cover the nursing child to provide warmth to the child and/or the woman. The cover 50 may also provide privacy before, during and after the nursing process.

Figure 13:
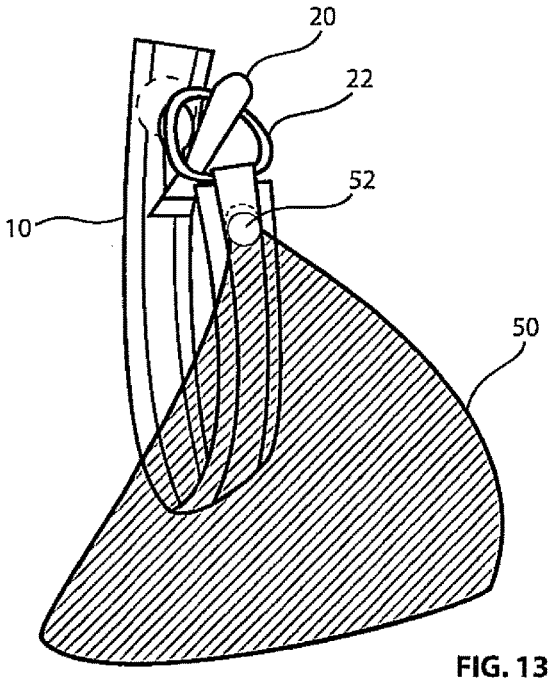
FIG. 13 illustrates a clothing clip in accordance with an embodiment of the present disclosure as used in accordance with the method disclosed herein.

In an embodiment, the cover 50 may have a magnet 52 that may be affixed to the cover 50. For example, the magnet 52 may be stitched and/or sewn to the cover 50. As shown in FIG. 13, the magnet 52 on the cover 50 may be attached to the clothing clip apparatus 10 by magnetic attraction to the clip 20. The magnet 52 may also be attracted to the magnet 30 on the clothing clip apparatus 10. As shown in FIG. 13, the magnet 52 may hold the cover 50 to the clothing clip apparatus 10 in use.

Figure 14:
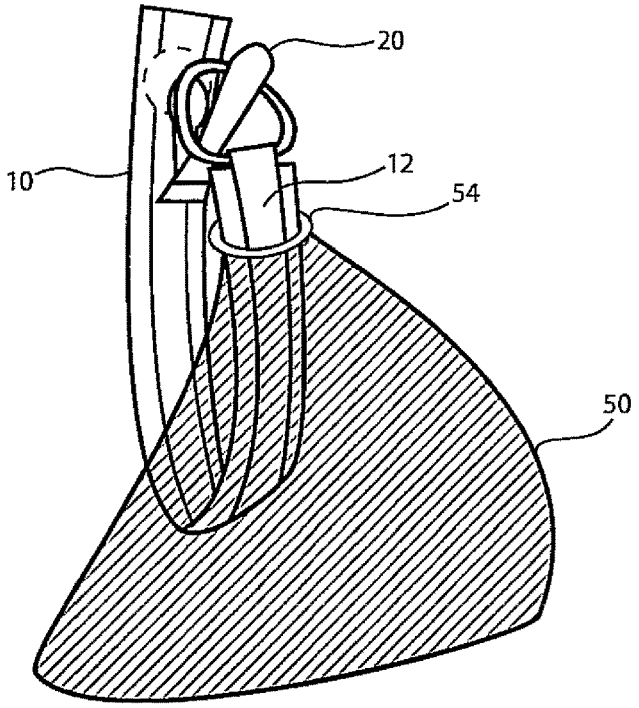
FIG. 14 illustrates a clothing clip in accordance with an embodiment of the present disclosure as used in accordance with the method disclosed herein.

In an embodiment, the cover 50 may have a ring 54 that may be used to affix the cover 50 to the clothing clip apparatus 10. For example, the ring 54 may be stitched and/or sewn to the cover 50. As shown in FIG. 14, the ring 54 on the cover 50 may be attached to the clothing clip apparatus 10 by looping the ring 54 over the clip 20 of the clothing clip apparatus 10. The ring 54 may also be connected to the clothing clip apparatus 10 by inserting the strap 12 of the clothing clip apparatus 10 through the ring 54. The strap 12 may hold the cover 50 to the clothing clip apparatus 10. The ring 22 of the clothing clip apparatus 10 may then be positioned over the top end 34 of the clip 20 to form a loop with the strap 12 around the garment 11. The ring 22 of the clothing clip apparatus 10 may hook onto the clip 20. As shown in FIG. 14, the ring 54 may hold the cover 50 to the clothing clip apparatus 10 in use. The cover 50 and the clothing clip apparatus 10 may be attached to each other to form a single unit. The cover 50 may be removed from the clothing clip apparatus 10 by the woman at the conclusion of the nursing process and/or as desired.

Figure 15:
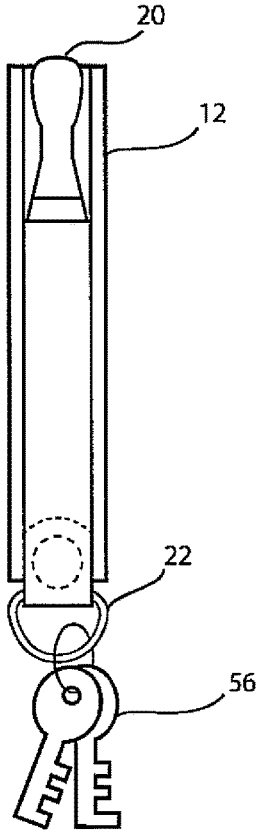
FIG. 15 illustrates a clothing clip in accordance with an embodiment of the present disclosure as used in accordance with the method disclosed herein.
Figure 16:
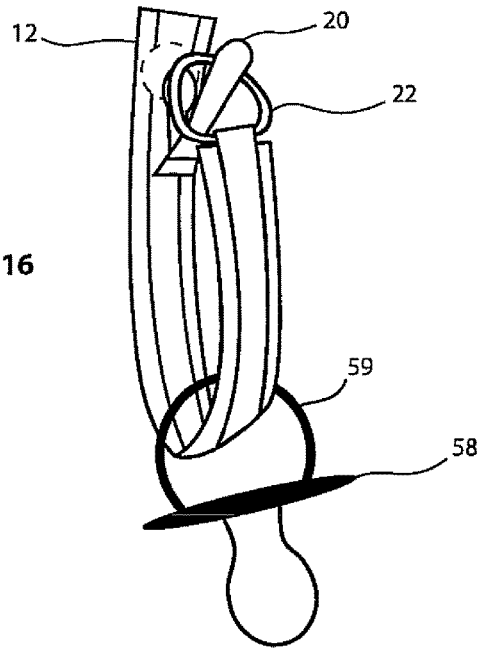
FIG. 16 illustrates a clothing clip in accordance with an embodiment of the present disclosure as used in accordance with the method disclosed herein.

As shown in FIGS. 15 and 16, the clothing clip apparatus 10 may be configured to hold an item, such as, keys 56 as shown in FIG. 15 and/or a pacifier 58 as shown in FIG. 16. A teething device, toys, building access cards, travel items, hand sanitizer, lip moisturizer, burp cloths, bibs, nursing covers and/or the like, for example, may also be held by the clothing clip apparatus 10. The clothing clip apparatus 10 may hold such an item until required by the user. As shown in FIG. 15, the keys 56 may be attached to the ring 22 of the clothing clip apparatus 10. As shown in FIG. 16, the pacifier 58 may be attached to the clothing clip apparatus 10 by inserting the strap 12 through a ring 59 on the pacifier 58. The ring 22 of the clothing clip apparatus 10 may then be positioned over the top end 34 of the clip 20 to form a loop with the strap 12 around the garment 11. The ring 22 of the clothing clip apparatus 10 may hook onto the clip 20. The strap 12 may hold the pacifier 58.

Figure 17:
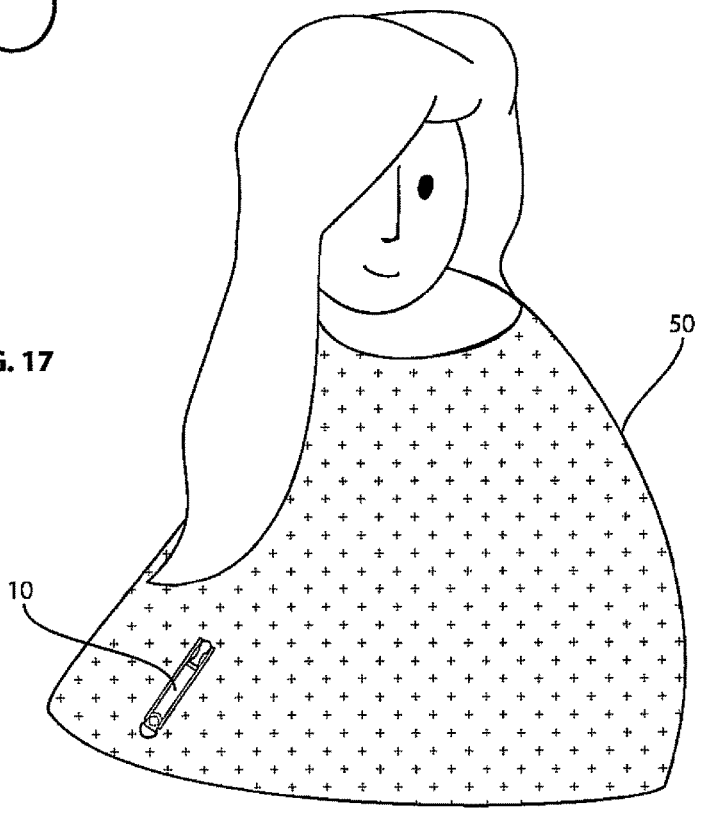
FIG. 17 illustrates a clothing clip in accordance with an embodiment of the present disclosure as used in accordance with the method disclosed herein.

In an embodiment, the clothing clip apparatus 10 may be attached to a piece of clothing of the user, such as the garment 11 and/or the cover 50 as shown in FIG. 17. The clothing clip apparatus 10 may attach to the garment 11 using a hook and loop fastener, for example. Moreover, the clip 20 of the clothing clip apparatus 10 may attach to the garment to hold the clothing clip apparatus 10 to the garment 11. The clothing clip apparatus 10 may be attached to the garment until the user may require the clothing clip apparatus 10.

Moreover, the present disclosure is not limited to the specific arrangement of the components illustrated in the figures. It should be understood that various changes and modifications to the presently preferred embodiments described herein will be apparent to those having ordinary skill in the art. Such changes and modifications may be made without departing from the spirit and scope of the present disclosure and without diminishing its attendant advantages. It is, therefore, intended that such changes and modifications be covered by the appended claims.

What is claimed is:

1. A method comprising the steps of:

producing a strap having a first end, a second end opposite the first end, and a length between the first end and the second end;

providing a fastener at the first end of the strap, the fastener having a first part attached to the strap and a movable part that is movable relative to the first part;

positioning a ring at the second end of the strap; and instructing the wearer to lift part of the garment to form a gathered portion of the garment, form a loop shape with the strap around the gathered portion, and utilize the ring to retain the strap in the loop shape to thereby hold the gathered portion of the garment in a fixed position relative to the wearer of the garment to expose a breast for nursing.

2. The method of claim 1, wherein, in the step of providing, the movable part is pivotable relative to the first part.

3. The method of claim 1, further comprising the step of:

further instructing the wearer of the garment to attach a cover to the strap whereby the cover is positioned over the garment and the exposed breast.

4. The method of claim 1, wherein the step of instructing further includes instructing the wearer to use only one hand to lift part of the garment, to form the loop shape in the strap around the gathered portion, and to utilize the ring to retain the strap in the loop shape.

5. An apparatus for holding a garment in a gathered position to expose a breast of a wearer of the garment, the apparatus comprising:

a strap having a first end, a second end opposite the first end, and a length between the first end and the second end;

a fastener at the first end of the strap, the fastener configured to connect the first end to a piece of clothing of the wearer, the fastener having a body portion attached to the strap and a movable part that is movable relative to the body portion; and a ring at the second end of the strap, the ring configured to retain the strap in a closed loop shape to hold the garment in the gathered position within the closed loop shape.

6. The apparatus of claim 5, further comprising:

a magnet at the first end of the strap wherein the magnet attracts the ring to retain the strap in the closed loop shape.

7. The apparatus of claim 5, wherein the length of the strap is adjustable.

8. The apparatus of claim 7, further comprising:

a series of magnets positioned lengthwise along the strap, each magnet of the series of magnets being attracted to the fastener.

9. The apparatus of claim 7, further comprising:

an adjustment slide positioned between the first end and the second end of the strap to set a desired length for the strap.

10. The apparatus of claim 5, further comprising:

a first magnet at the first end of the strap; and a second magnet at the second end of the strap, wherein the first magnet and the second magnet are attracted to one another.

11. The apparatus of claim 5, further comprising:

a fabric pocket formed in the strap, wherein the fabric pocket is configured to enclose an object.

12. The apparatus of claim 5, further comprising:

a cover that attaches to and hangs from the strap to cover the exposed breast.

13. The apparatus of claim 5, wherein the fastener is configured to attach to a neck opening or a collar on the garment.

14. An apparatus for holding a garment to expose a breast for nursing, the apparatus comprising:

a strap having a first end and a second end spaced lengthwise from the first end;

a clip with a fixed base attached to the first end of the strap, the clip having a movable part that protrudes and is movable relative to the fixed base to attach the strap to a piece of clothing of a wearer of the garment;

a magnetic portion disposed at the first end of the strap; and a magnet attached to the second end of the strap, wherein the magnetic portion attracts the magnet to connect the second end to the first end to configure the strap in a closed loop shape to retain the garment in a gathered position within the closed loop shape.

15. The apparatus of claim 14, wherein the magnetic portion is an auxiliary magnet or a metallic portion of the clip.

16. The apparatus of claim 14, further comprising:

one or more additional magnets located at various positions along a length of the strap to permit the closed loop shape to be configured having a selected size.

17. The apparatus of claim 14, further comprising:

an attachment device configured to engage the clip to assist in forming the closed loop shape.

18. The apparatus of claim 17, wherein the attachment device is a ring attached to the second end of the strap, the ring configured to removably engage the clip.

19. A method comprising the steps of:

holding, with one hand, a strap having a first end and a second end opposite the first end;

manipulating a fastener at the first end of the strap, with the one hand, to attach the strap to a piece of clothing, the fastener having a first part attached to the strap and a movable part that is movable relative to the first part;

lifting part of a garment, with the one hand, to form a gathered portion of the garment;

forming, with the one hand, a loop shape with the strap around the gathered portion of the garment; and utilizing, with the one hand, a ring at the second end of the strap to retain the strap in the loop shape to thereby hold the gathered portion of the garment in a fixed position relative to a wearer of the garment to expose a breast of the wearer for nursing.

20. The method of claim 19, wherein the step of manipulating further includes manipulating the fastener, with the one hand, to attach the strap to the garment.

* * * * *